US007431005B2

(12) United States Patent
Hawkins et al.

(10) Patent No.: US 7,431,005 B2
(45) Date of Patent: Oct. 7, 2008

(54) ENGINE START/STOP CONTROL FOR MULTIPLE ENGINE OHV BASED ON OPERATING CONDITIONS

(75) Inventors: William Charles Hawkins, Mt. Vernon, IL (US); Sean James McManus, Calgary (CA)

(73) Assignee: National Railway Equipment Co., Mount Vernon, IL (US)

( * ) Notice: Subject to any disclaimer, the term of this patent is extended or adjusted under 35 U.S.C. 154(b) by 70 days.

(21) Appl. No.: 11/469,317

(22) Filed: Aug. 31, 2006

(65) Prior Publication Data

US 2008/0053402 A1 Mar. 6, 2008

(51) Int. Cl.
*F02N 17/00* (2006.01)
*F02D 41/00* (2006.01)

(52) U.S. Cl. ..... 123/179.4; 60/698; 60/706; 123/DIG. 8

(58) Field of Classification Search ..... 123/179.3, 123/179.4, DIG. 8; 60/698, 704, 706; 701/19
See application file for complete search history.

(56) References Cited

U.S. PATENT DOCUMENTS 3,220,192 A 11/1965 Sheppard et al.
3,703,663 A 11/1972 Wagner
4,136,286 A 1/1979 O'Halloran et al.
4,413,595 A 11/1983 Potts, Jr.
4,900,944 A 2/1990 Donnelly
6,066,897 A 5/2000 Nakamura
6,636,798 B2 * 10/2003 Biess et al. ..... 123/179.4
6,650,993 B2 * 11/2003 Wolf et al. ..... 123/179.4
6,935,115 B2 * 8/2005 Anderson ..... 60/698
7,204,222 B2 * 4/2007 Yamauchi et al. ..... 123/179.4
7,304,445 B2 12/2007 Donnelly
7,309,929 B2 12/2007 Donnelly et al.
2002/0033157 A1 * 3/2002 Thompson et al. ..... 123/179.4
2003/0029406 A1 * 2/2003 Weiss ..... 123/179.4
2004/0055558 A1 3/2004 McElroy
2004/0262995 A1 * 12/2004 Hawkins ..... 307/10.6
2005/0206331 A1 9/2005 Donnelly
2005/0251299 A1 11/2005 Donnelly et al.
2006/0021808 A1 2/2006 McGee et al.
2008/0082247 A1 * 4/2008 Hawkins et al. ..... 701/101

* cited by examiner

*Primary Examiner*—T. M Argenbright
(74) *Attorney, Agent, or Firm*—Senniger Powers LLP

(57) ABSTRACT

Operation of a second or additional engine is initiated based on throttle position, vehicle speed and output level of the operating engine or engines. A second or additional engine is stopped based on throttle position and operation of the first engine when the second or additional engine has been idling for a predetermined period of time. Idling of an engine is started or stopped based on various conditions of the vehicle, such as battery voltage, ambient air temperature, brake cylinder pressure, operator input, battery charging current, and direction input.

22 Claims, 3 Drawing Sheets

ENGINE START/STOP CONTROL FOR MULTIPLE ENGINE OHV BASED ON OPERATING CONDITIONS

FIELD OF THE INVENTION

The present invention generally relates to the control and operation of multiple sources of power and, in particular, to systems and methods of starting and stopping engines of a locomotive.

BACKGROUND OF THE INVENTION

Off highway vehicles, such as locomotives, which have multiple engines implement various scenarios for selectively operating the engines. For example, some locomotive control scenarios simultaneously operate all engines at all times.

There is a need for more efficient scenarios for starting a second or additional engine after one or more engines are already operating. There is also a need for efficient scenarios for stopping operation of additional engines. Alternatively, and in addition, there is also a need for efficient scenarios for stopping operation of a primary engine. Alternatively, and in addition, there is also a need for efficient scenarios for controlling engine idle in a single or multiple engine system.

These scenarios should take into account the delivery of power in response to operator demand, the cost of fuel, various ways to efficiently use engine fuel and efficiently operate engines, and the cost of engine maintenance and repair.

SUMMARY OF THE INVENTION

In one embodiment, operation of a second or additional engine is initiated based on throttle position or rpm setting, vehicle speed and output level of the operating engine or engines. In another embodiment, a second or additional engine is stopped based on throttle position or rpm setting and operation of the first engine when the second or additional engine has been idling for a predetermined period of time. In another embodiment, idling of an engine is started or stopped based on various conditions of the vehicle, such as battery voltage, ambient air temperature, brake cylinder pressure, operator input, battery charging current, and direction input.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
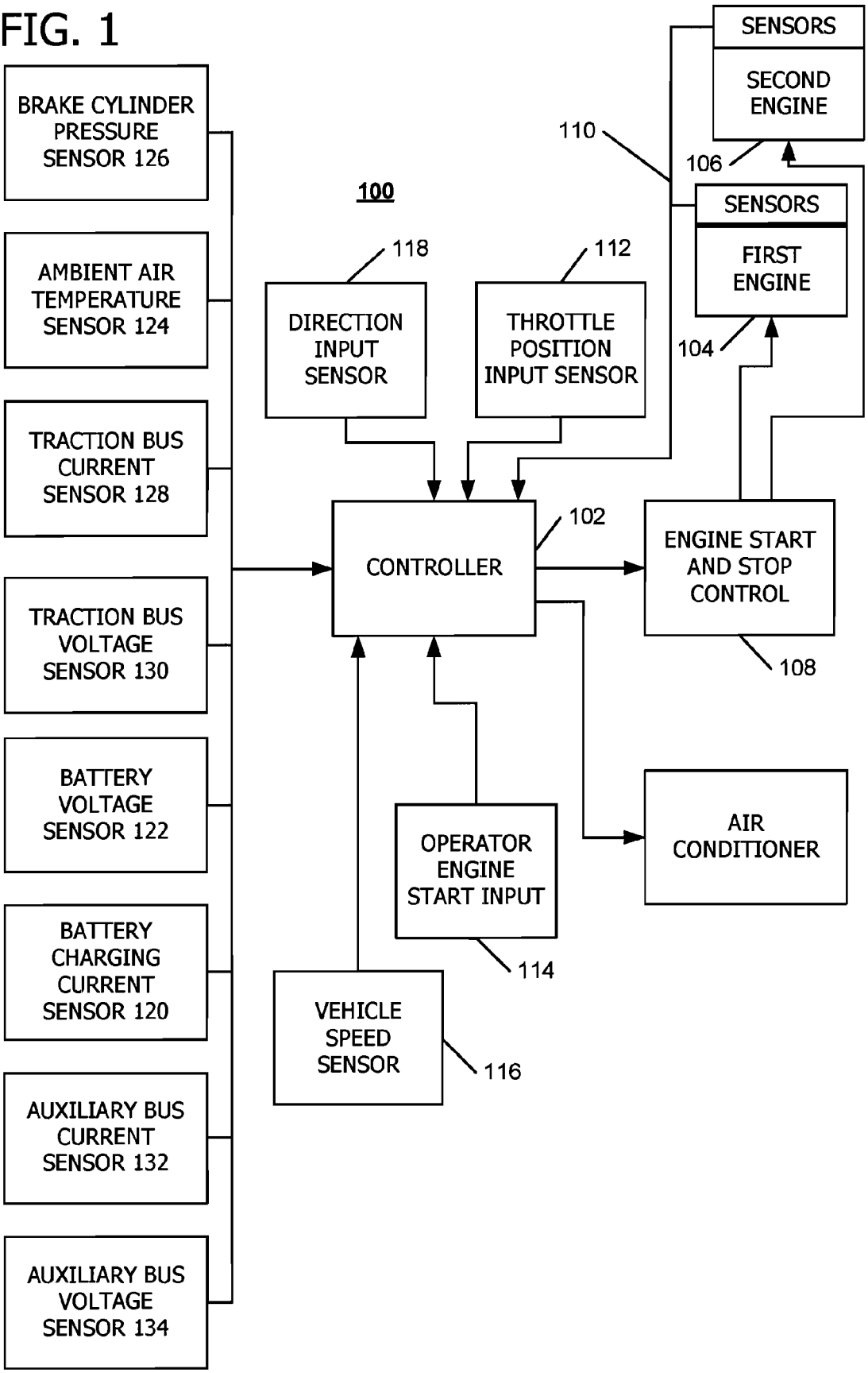
FIG. 1 is a block diagram of one embodiment of an off highway vehicle of the invention.

As shown in FIG. 1, an off-highway vehicle 100 has a plurality of engines which are operating in response to a controller 102. FIG. 1 illustrates the vehicle 100 with two engines, a first engine 104 and a second engine 106. However, it is contemplated that the vehicle 100 may have two or more engines and FIG. 1 includes only two engines for simplicity. Vehicle 100 also includes an engine start and stop control 108 which interfaces with the controller 102 and is linked to the engines 104, 106 to initiate their operation and to terminate their operation. The engine start and stop control 108 independently controls each of the engines 104, 106. Line 110 illustrates a link between sensors of each of the engines 104, 106 and the controller. In particular, link 110 between sensors of the engines and the controller 102 provides information to the controller regarding the status and/or operation of each of the engines (e.g., various parameters of the engines such as rpms, operating power output, temperature and other engine operating parameters).

In one embodiment, the engines 104, 106 are operated in response to a throttle position input sensor 112 (or an rpm sensor) which indicates the position of the throttle as controlled by the operator. In addition, there may be an optional operator engine start input 114 where the operator can directly or indirectly instruct the controller 102 (e.g., via a keypad) with regard to operation of the engines or termination of operation of the engines. In addition, a vehicle speed sensor 116 for indicating vehicle speed and/or a direction input sensor 118 for indicating desired direction of movement of the vehicle 100 may provide information to the controller 102.

In an embodiment when the first and second engines are not operating, the controller 102 will initiate operation of the first engine 104 when the throttle position input sensor 112 indicates that the throttle has been moved by the operator from one position (e.g., an idle position) to a position which requires additional power. For example, off-highway vehicles frequently have throttles with a notch positions idle, and 1-9 and controller 102 would initiate operation of the first engine 104 by signaling the engine start and stop control 108 when the throttle position sensor 112 senses movement of the throttle from position idle to position 1. As described herein, embodiment of the invention will be presented with reference to throttle notch positions. However, it is contemplated that any type of throttle configuration may be used in combination with embodiments of the invention.

Figure 2:
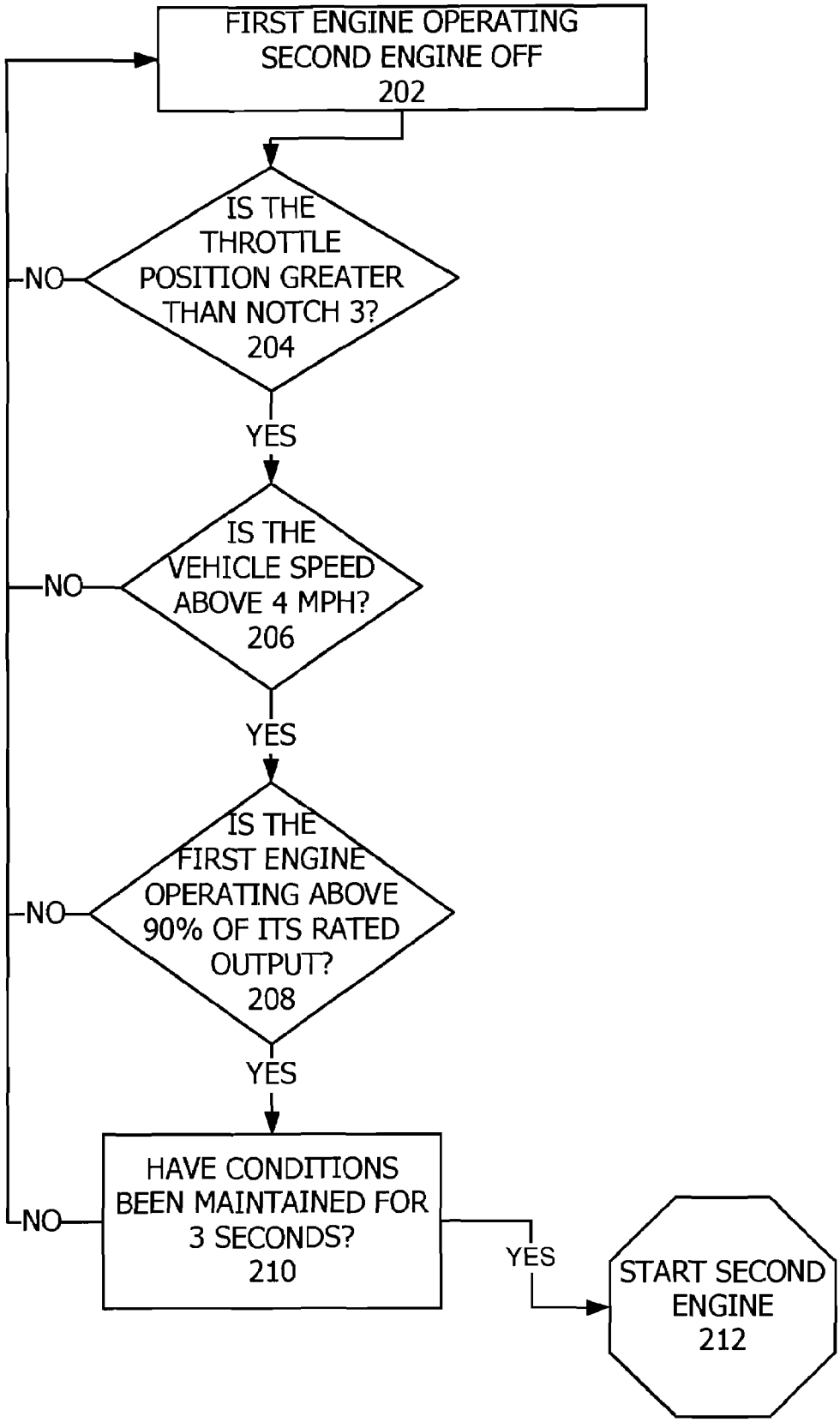
FIG. 2 is a flow chart illustrating one embodiment of the invention for starting a second engine.

In an embodiment when the first engine 104 of the off-highway vehicle 100 is operating and the second engine 106 is not operating, the operation of the second engine will be initiated by the controller 102 via engine control 108 when a set of operating conditions with regard to the first engine are met. As illustrated in FIG. 2, these conditions include at least one of the following: (1) the throttle position as indicated by sensor 112, (2) a vehicle speed as indicated by sensor 116 and/or (3) an operating output of the first engine as indicated by the first engine sensors via line 110.

In particular, a flow chart illustrated in FIG. 2 indicates one embodiment of the operation of the controller 102. In general, it is contemplated that the controller may be any programmable device such as a processor or programmable logic controller (PLC). The controller 102 monitors operation of the first and second engines via 110. At block 202, engine sensors indicate to the controller that operation of the vehicle 100 has been started and that the first engine 104 is operating. At 204, the controller 102 evaluates the output of the throttle sensor 112 to determine whether the throttle position is greater than a predetermined setting (e.g., notch 3). If the throttle position is 3 or less, the controller returns to block 202 and continues to monitor the throttle position at 204 without initiating operation of the second engine 106. However, when the throttle position is sensed at 204 to have been moved to a notch position greater than the predetermined setting (e.g., notch 4 or higher), the controller 102 evaluates the output of the vehicle speed sensor 116 to determine the speed of the vehicle 100. If the vehicle speed is equal to or below a predetermined speed (e.g., 4 mph), the controller 102 continues to monitor the throttle position at 204 and vehicle speed at 206. If the vehicle speed is above the predetermined speed (e.g., greater than 4 MPH), the controller via 110 determines at 208 the output level of the first engine and compares that to a predetermined output level. For example, the output level may be indicated to the controller 102 by a brake output, such as indicated by a traction bus current sensor 128, a traction bus voltage sensor 130, an auxiliary bus current sensor 132 and an auxiliary bus voltage sensor 134, the corresponding sum of these sensors being indicative of the total output of the first engine 106 when the second engine 104 is not operating. If the first engine is operating above a predetermined output level (e.g., above 90% of its rated output), the controller at 212 initiates the operation of the second engine 106. Alternatively, if the first engine is not operating above the predetermined output level, the controller continues to monitor the throttle position and vehicle speed until such time as the throttle position is above the predetermined throttle position and the first engine is operating above the predetermined output level.

In summary, as illustrated in FIG. 2, when the controller 102 determines that the throttle position is greater than notch 3, the vehicle speed is above 4 MPH and the first engine is operating above 90% of its rated output, the controller begins the process of initiating operation of the second engine. This process may optionally include a delay or timer which is indicated at 210. In particular, the controller may be programmed to confirm that the throttle position, vehicle speed and engine output are as required and been maintained for at least a period of time such as three seconds before the controller initiates operation of the second engine at 112. Thus, the delay or timer minimizes the possibility that the three conditions of throttle position, vehicle speed and engine operation only momentarily reach the required levels, which could result in premature initiation of the operation of the second engine 106.

As illustrated in FIG. 2 in one embodiment, the predetermined throttle position, the predetermined speed and the predetermined output level are specified as notch position 3, 4 MPH and 90%, respectively. However, it is contemplated that these predetermined conditions can be of any value and, in one embodiment, the predetermined conditions may be a function of at least one of the following of features of the off-highway vehicle 100: a horsepower rating of each of the plurality of engines, a current capacity of a traction motor of the off-highway vehicle, and/or an engine configuration of the off-highway vehicle. For example, if the horsepower rating of the second engine is much greater than the horsepower rating of the first engine, the notch position which is required to start the second engine may be lower, e.g., 2. Similarly, if the current capacity of a traction motor of the vehicle is very high and the throttle position has changed by 2 or more notches, the second engine may start sooner rather than later at a lower speed. Also, if the engine configuration is such that the engines are more efficient when running in tandem at similar outputs, the predetermined conditions may be adjusted to enhance that aspect of the engine configuration.

Thus, embodiments of the invention increase fuel economy by minimizing, to some extent, the operation of the second engine when the first engine has sufficient output to manage the requirements of the vehicle. Other embodiments of the invention, such as illustrated in FIG. 2, minimize operation of the second engine thereby reducing maintenance and wear and tear of the second engine.

Other embodiments relate to control of the revolutions per minute of the second engine 206 when operating simultaneously with first engine 104. In one embodiment, the controller 102 increases the revolutions per minute of the second engine 106 to a predetermined revolutions per minute (e.g., from 0 to 1500) and decreases the revolutions per minute of the first engine to a predetermined revolutions per minute (e.g., from 1800 to 1500). This approach may be used when the engines are in parallel. Alternatively, in another embodiment, the controller may maintain the revolutions per minute of the first engine 104 and increase the revolutions per minute of the second engine 106 to a predetermined revolutions per minute. This approach may be used when the engines are in series.

Other embodiments relate to stopping the second or an additional engine and/or eventually stopping the first or primary engine. For example, stopping the second engine may be implemented in response to an operator reducing a throttle position of the vehicle 100 to a predetermined amount such as moving the throttle from notch 3 to notch 2. In response to a reduced throttle position or any other detected condition of the off-highway vehicle which would indicate a reduction in power needs, the controller 102 reduces the revolutions per minute of the second engine 106 to an idle setting and thereafter controls the revolutions per minute of the second engine 106 as a function of the throttle position. For example, the second engine may not be increased in speed as long as the throttle remains at a particular setting (e.g., idle) or below a particular setting. While the second engine 106 is at idle, the controller 102 controls the revolutions per minute of the first engine as a function of the throttle position. Alternatively, and in addition, it is contemplated in one embodiment of the invention that the controller 102 may stop the second engine 106 after a predetermined period of time during which the second engine has been idle.

Thus, one embodiment of the invention as illustrated by FIGS. 1 and 2 includes an off-highway vehicle comprises a plurality of engines 104, 106 and a controller 102 for controlling operation of the engines. When the first engine 104 is operating and the second engine 106 is not operating, the controller initiates operation of the second engine when the following operating conditions are met:

a throttle position of the off-highway vehicle 100 as indicated by the throttle sensor 112 is greater than a predetermined throttle position;

a speed of the off-highway vehicle as indicated by the speed sensor 116 is greater than a predetermined speed; and the first engine 104 is operating at an output level greater than a predetermined output level, as indicated by the traction bus sensors 128, 130 and the auxiliary bus sensors 132, 134.

Figure 3:
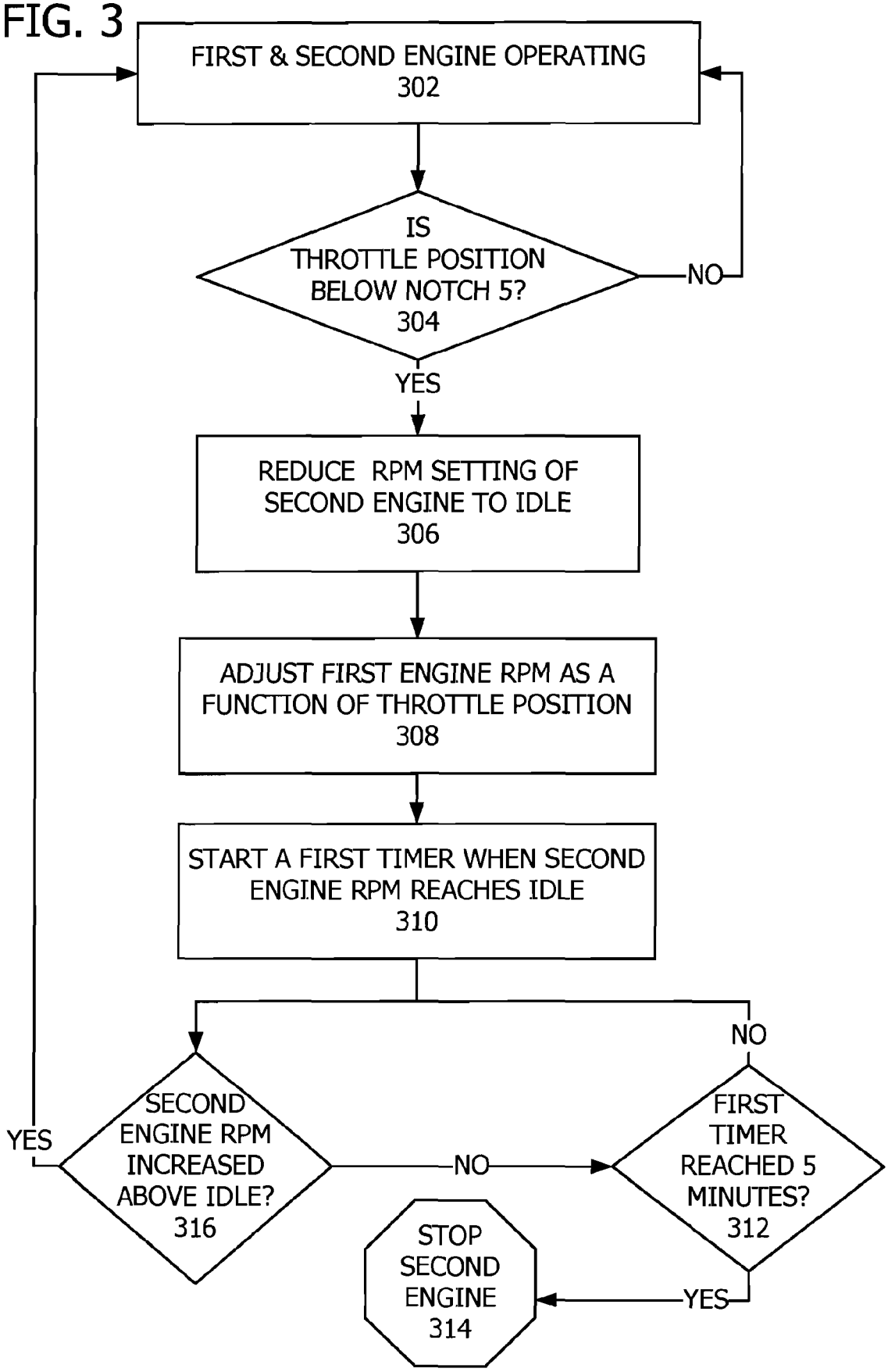
FIG. 3 is a flow chart illustrating one embodiment of the invention for stopping a second engine.

FIG. 3 illustrates one embodiment of this aspect of the invention. It is contemplated that the controller 102 may operate according to FIG. 2 only, according to FIG. 3 only, or according FIGS. 2 and 3 simultaneously. At 302, both the first engine 104 and the second engine 106 are operating. At 304, the controller 102 monitors the position of the throttle. When the throttle position input sensor 112 indicates that the throttle has been moved to a position below notch 5, controller 102 reduces the rpms setting of the second engine 106 to an idle setting at 306. Thereafter, the controller 102 adjusts the first engine rpms as a function of the throttle position as long as the throttle setting remains below notch 5, as indicated at 308. For example, if the throttle notch setting is 2 (which is below notch 5) and is moved to notch 3, the first engine rpms would be increased corresponding to notch 3. At 310, a first timer is initiated by the controller 102 wherein the controller determines the amount of time that the second engine 106 remains at the idle setting. If the second engine 106 has been idling for a preset time (e.g., at least five minutes) as determined at 312, the controller proceeds to 314 to stop the second engine.

Alternatively, if the second engine rpms have increased above idle as determined at 316, the controller proceeds to 302 and continues operation of the second engine. For example, an increase in throttle position to notch 5 or above, at a speed above 4 mph with the first engine operating over 90% of its rated output, per FIG. 2, would result in the second engine rpms increasing above idle so that the controller 102 would proceed from 316 to 302. Thus, the operations of the controller as illustrated by FIGS. 2 and 3 are simultaneously applied to the second engine 106. In particular, the controller 102 would increase the revolutions per minute of the second engine above idle when sensing the following conditions: a throttle position of the off-highway vehicle greater than a predetermined position, a speed of the off-highway vehicle greater than a predetermined speed and an output level of the first engine 104 greater than a predetermined output level. As noted above, this implementation of an increase in the revolutions per minute of the second engine may be delayed at 210 for a predetermined period of time until the conditions are met for the entire predetermined period.

Alternatively, the controller 102 may be configured to immediately increase the revolutions per minute of the second engine above an idle setting as a function of the throttle position. For example, any increase in the notch setting of the throttle would be implemented to include an increase in the revolutions per minute of the second engine 106. Once the second engine has stopped at 314, the controller may implement the control scenario of FIG. 2 to restart the second engine.

Alternatively, or in addition, the controller may implement a scenario to shut down the first or primary engine 104. In one embodiment, the controller 102 stops operation of the first engine after a predetermined period of idling of the first engine (e.g., 1 hour) when any one or more of the following conditions are present for a predetermined period (e.g., 15 minutes):

a sensor 120 indicating to the controller 102 that a battery charging current being applied to a battery is less than a predetermined battery charging current (e.g., 20 amperes, indicating a charged battery);

a sensor 122 indicating to the controller 102 that a battery voltage is greater than a predetermined battery voltage (e.g., 69 volts, indicating a charged battery);

a sensor 124 indicating to the controller 102 that an ambient air temperature is greater than a predetermined ambient air temperature (e.g., 10 degrees Fahrenheit, indicating no need for auxiliary heating)

the sensor 118 indicating to the controller 102 that a direction input in neutral (indicating no demand for directional movement); and/or a sensor 126 indicating to the controller 102 that a brake cylinder pressure above a predetermined brake cylinder pressure (e.g., 22 psi, indicating sufficient operating pressure for the brakes).

Alternatively, in addition, the controller 102 may implement shut down of the primary engine only when all five of the above noted conditions are met simultaneously throughout a predetermined period of time. In another embodiment, the controller may shut down the primary engine when the revolutions per minute of the primary engine reaches an idle setting and is reset only if the revolutions per minute of the primary engine increases above the revolutions per minute corresponding to idle. Alternatively, in another embodiment, the controller may begin the predetermined period of idling when the throttle position is in a position corresponding to idle and the direction position in neutral, and such a period of time can only be reset if the revolutions per minute of the first engine increase above the revolutions per minute corresponding to idle. In addition, the controller may determine when the vehicle produces no substantial motive force and may shut down the air conditioning system (driven by the auxiliary bus) of the off-highway vehicle after a predetermined period of time of vehicle idling time with no substantial motive force.

Thus, one embodiment of the invention as illustrated in FIGS. 1 and 3, comprises an off-highway vehicle 100 including a plurality of engines 104, 106 and a controller 102 for controlling operation of the engines. When the first engine 104 and the second engine 106 of the plurality of engines are operating and the operator reduces the throttle position as indicated by throttle sensor 112 to a predefined amount, the controller operates the second engine at a revolutions per minute corresponding to an idle condition. Thereafter, the controller 102 controls the second engine 106 revolutions per minute as a function of the throttle position as indicated by sensor 112 and the controller 102 controls the revolutions per minute of the first engine 104 as a function of the throttle position as indicated by sensor 112. The controller 102 stops the second engine 106 after a predetermined period of time during which the second engine has been in the idle condition.

In another embodiment of the invention, transitioning the first or primary engine from an idle condition to an operating condition, and/or transitioning from idle to stop, may also be controlled by the controller 102. In one embodiment, one or more of the engines 104, 106 are started by the controller 102 in response to any one or more of the following conditions:

(1) a battery voltage is less than a predetermined first battery voltage (e.g., 60 volts);

(2) an ambient air temperature is less than a predetermined first ambient air temperature (e.g., zero degrees Fahrenheit);

(3) a direction input is changed from neutral to either forward or reverse;

(4) a brake cylinder pressure is below a predetermined first brake cylinder pressure (e.g., 18.5 psi); and/or (5) an engine start input is activated by an operator via input 114.

In one embodiment, the engine is stopped in response to any one or more of the following conditions:

(1) a battery charging current is less than a predetermined battery charging current (e.g., 20 amperes);

(2) a battery voltage is greater than a predetermined second battery voltage (e.g., 69 volts);

(3) an ambient air temperature is greater than a predetermined second ambient air temperature (e.g., 10 degrees Fahrenheit);

(4) a direction input is in neutral; and/or (5) a brake cylinder pressure is above a predetermined second brake cylinder pressure (e.g., 22 psi).

Alternatively or in addition, the air conditioning system of the off-highway vehicle may be shut down after a predetermined period of time (e.g., 1 hour) during which the engine or engines are in the idle state.

As noted above, in addition, the predetermined idle state may begin based on any of the scenarios noted above. In one embodiment, the predetermined idle period of time begins when all of the shutdown conditions are met and the predetermined idle period of time is restarted if any of the shutdown conditions are violated. In another embodiment, the predetermined idle period of time begins when all of the engines of the off-highway vehicle have reached an rpm corresponding to idle and is only restarted if any of the engines are increased to a revolutions per minute above the revolutions per minute corresponding to idle such that if none of the engines of the off-highway vehicle have been at a revolutions per minute above a revolutions per minute corresponding to idle for the predetermined idle period of time and the shutdown conditions are met at the end of the predetermined idle period of time, the engines are stopped. In another embodiment, the predetermined idle period time begins when the throttle position is in a position corresponding to idle and the direction input is in neutral, and is restarted only if the revolutions per minute of the first engine increase above the revolutions per minute corresponding to idle.

Thus, one embodiment comprises an off-highway vehicle having an engine in an idle state wherein the engine produces no motive force in the idle state and wherein the engine is in the idle state. The vehicle comprises an engine 104, 106 and a controller 102 for controlling operation of the engine. The controller monitors at least one of a battery voltage of the vehicle, an ambient air temperature of the vehicle, a direction input of the vehicle, a brake cylinder pressure of the vehicle, an engine start input of the vehicle, and a battery charging current via sensors, as noted above. The controller starts the engine in response to at least one of the following start-up conditions:

- the monitored battery voltage is less than a predetermined first battery voltage;
- the monitored ambient air temperature is less than a predetermined first ambient air temperature;
- the monitored direction input is changed from neutral to either forward or reverse;
- the monitored brake cylinder pressure is below a predetermined first brake cylinder pressure; and
- the monitored engine start input is activated by an operator.

The controller stops the engine after a predetermined idle period of time in response to at least one of the following shutdown conditions:

- the monitored battery charging current is less than a predetermined battery charging current;
- the monitored battery voltage is greater than a predetermined second battery voltage;
- the monitored ambient air temperature is greater than a predetermined second ambient air temperature;
- the monitored direction input is in neutral; and
- the monitored brake cylinder pressure is above a predetermined second brake cylinder pressure.

The controller described herein for executing instructions embodying methods of the present invention may be a computer, a dedicated computing device, a network of computing devices, or any other similar device.

The order of execution or performance of the operations in embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

Embodiments of the invention may be implemented with computer-executable instructions. The computer-executable instructions may be organized into one or more computer-executable components or modules. Aspects of the invention may be implemented with any number and organization of such components or modules. For example, aspects of the invention are not limited to the specific computer-executable instructions or the specific components or modules illustrated in the figures and described herein. Other embodiments of the invention may include different computer-executable instructions or components having more or less functionality than illustrated and described herein.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

Having described aspects of the invention in detail, it will be apparent that modifications and variations are possible without departing from the scope of aspects of the invention as defined in the appended claims.

As various changes could be made in the above constructions, products, and methods without departing from the scope of aspects of the invention, it is intended that all matter contained in the above description and shown in the accompanying drawings shall be interpreted as illustrative and not in a limiting sense.

What is claimed is:

1. A method of operating an off-highway vehicle having a plurality of engines wherein a first engine of the plurality of engines is operating and a second engine of the plurality of engines is not operating, said method comprising:

initiating operation of the second engine when a set of operating conditions are met, said operating conditions comprising:

a throttle position of the off-highway vehicle is greater than a predetermined throttle position;

a speed of the off-highway vehicle is greater than a predetermined speed; and the first engine is operating at an output level greater than a predetermined output level.

2. The method of claim 1 further comprising delaying said initiating operation until said operating conditions are met for a predetermined period of time, wherein said initiating operation is not performed when at least one of the operating conditions are not met during the predetermined period of time.

3. The method of claim 2 wherein:

the predetermined period of time is 3 seconds;

the predetermined throttle position is notch 3;

the predetermined speed is 4 miles per hour; and the predetermined output level is 90% of a horsepower rating of the first engine.

4. The method of claim 1 wherein the predetermined throttle position, predetermined speed, and predetermined output level are determined as a function of at least one of a horsepower rating of each of the plurality of engines, a current capacity of a traction motor of the off-highway vehicle, and an engine configuration of the off-highway vehicle.

5. The method of claim 1 wherein said initiating operation comprises:

increasing a revolutions per minute of the second engine to a predetermined revolutions per minute; and decreasing a revolutions per minute of the first engine to the predetermined revolutions per minute.

6. The method of claim 1 wherein said initiating operation comprises:

maintaining the revolutions per minute of the first engine; and increasing the revolutions per minute of the second engine to a predetermined revolutions per minute.

7. An off-highway vehicle comprising:

a plurality of engines;

a controller for controlling operation of the engines, wherein when a first engine of the plurality of engines is operating and a second engine of the plurality of engines is not operating, said controller initiates operation of the second engine when a set of operating conditions are met, said operating conditions comprising:

a throttle position of the off-highway vehicle is greater than a predetermined throttle position;

a speed of the off-highway vehicle is greater than a predetermined speed; and the first engine is operating at an output level greater than a predetermined output level.

8. A method of operating an off-highway vehicle having a plurality of engines wherein a first engine and a second engine of the plurality of engines are operating and an operator reduces a throttle position of the off-highway vehicle to a predefined amount, said method comprising:

operating the second engine at a revolutions per minute corresponding to an idle condition and thereafter controlling the second engine revolutions per minute as a function of the throttle position;

controlling the first engine revolutions per minute as a function of the throttle position; and stopping the second engine after a predetermined period of time during which the second engine has been in the idle condition.

9. The method of claim 8 further comprising:

increasing the revolutions per minute of the second engine above the revolutions per minute setting corresponding to idle when a set of operating conditions are met, said operating conditions comprising:

a throttle position of the off-highway vehicle is greater than a predetermined position;

a speed of the off-highway vehicle is greater than a predetermined speed; and an output level of the first engine is greater than a predetermined output level.

10. The method of claim 9 further comprising delaying said increasing the revolutions per minute of the second engine until said operating conditions are met for a predetermined period of time, wherein said increasing is not performed when at least one of the operating conditions are not met during the predetermined time.

11. The method of claim 9 wherein:

the predetermined shutoff time is 5 minutes;

the predetermined period of time is 3 seconds the predefined amount of throttle position adjustment is the amount that adjusts the throttle position to notch 3 or lower;

the predetermined speed is 4 miles per hour; and the predetermined output level is 90% of a horsepower rating of the first engine.

12. The method of claim 8 further comprising increasing the revolutions per minute of the second engine above the revolutions per minute setting corresponding to idle as a function of the throttle position.

13. The method of claim 8 wherein the operator reduces the throttle position of the off-highway vehicle to idle, said method further comprising:

stopping the first engine after a predetermined period of idling time in response to at least one of the following conditions:

a battery charging current less than a predetermined battery charging current;

a battery voltage greater than a predetermined battery voltage;

an ambient air temperature greater than a predetermined ambient air temperature;

a direction input in neutral; and a brake cylinder pressure above a predetermined brake cylinder pressure.

14. The method of claim 13 wherein at least one of:

(1) the predetermined period of idling time begins when all of the conditions are met;

(2) the predetermined period of idling time begins when the first engine revolutions per minute reaches a revolutions per minute corresponding to idle and is reset only if the revolutions per minute of the first engine increases above the revolutions per minute corresponding to idle; and (3) the predetermined period of idling time begins when the throttle position is in a position corresponding to idle and the direction input is in neutral, and is reset only if the revolutions per minute of the first engine increases above the revolutions per minute corresponding to idle.

15. The method of claim 13 wherein the off-highway vehicle has an idle state wherein the off-highway vehicle produces no motive force, said method farther comprising shutting down an air conditioning system of the off highway vehicle after a predetermined period of off highway vehicle idling time.

16. The method of claim 15 wherein:

the predetermined period of off highway vehicle idling time is 1 hour;

the predetermined battery charging current is 20 amperes;

the predetermined battery voltage is 69 volts;

the predetermined ambient air temperature is 10 degrees Fahrenheit;

the predetermined brake cylinder pressure is 22 pounds per square inch; and the predetermined period of idling time is 15 minutes.

17. An off-highway vehicle comprising:

a plurality of engines;

a controller for controlling operation of the engines wherein when a first engine and a second engine of the plurality of engines are operating and an operator reduces a throttle position of the off-highway vehicle to a predefined amount, said controller:

operates the second engine at a revolutions per minute corresponding to an idle condition and thereafter controls the second engine revolutions per minute as a function of the throttle position;

controls the first engine revolutions per minute as a function of the throttle position; and stops the second engine after a predetermined period of time during which the second engine has been in the idle condition.

18. A method of minimizing fuel consumption of an engine of an off-highway vehicle having an idle state wherein the engine produces no motive force in the idle state and wherein the engine is in said idle state, said method comprising:

starting the engine in response to at least one of the following start-up conditions:

a battery voltage less than a predetermined first battery voltage;

an ambient air temperature less than a predetermined first ambient air temperature;

a direction input changed from neutral to either forward or reverse;

a brake cylinder pressure below a predetermined first brake cylinder pressure; and an engine start input activated by an operator; and stopping the engine after a predetermined idle period of time in response to at least one of the following shutdown conditions:

a battery charging current less than a predetermined battery charging current;

a battery voltage greater than a predetermined second battery voltage;

an ambient air temperature greater than a predetermined second ambient air temperature;

a direction input in neutral; and a brake cylinder pressure above a predetermined second brake cylinder pressure;

wherein at least one of:

(1) the predetermined idle period of time begins when all of the shutdown conditions are met and the predetermined idle period of time is restarted if any of the shutdown conditions are violated;

(2) the predetermined idle period of time begins when all of the engines of the off-highway vehicle have reached a revolutions per minute corresponding to idle and the predetermined idle period of time is only restarted if any of the engines are increased to a revolutions per minute above the revolutions per minute corresponding to idle such that if none of the engines of the off-highway vehicle have been at a revolutions per minute above a revolutions per minute corresponding to idle for the predetermined idle period of time and the shutdown conditions are met at the end of the predetermined idle period of time, the engines are stopped;

(3) the predetermined idle period time begins when a throttle position of the off-highway vehicle is in a position corresponding to idle and the direction input is in neutral, and the predetermined idle period of time is restarted only if the revolutions per minute of the engine increases above the revolutions per minute corresponding to idle;

(4) the predetermined idle period of time begins when the throttle position is changed to the position corresponding to idle and the predetermined idle period of time is restarted only if the throttle position is changed to a position other than the position corresponding to idle; and (5) the predetermined idle period of time begins when a revolutions per minute setting of the engine is set to an idle setting and the engine is stopped when the predetermined idle period of time ends and all of the shutdown conditions are met, wherein the predetermined idle period of time is reset only if the throttle position is changed from the position corresponding to idle to another position.

19. The method of claim 18 wherein:

the predetermined first battery voltage is 60 volts;

the predetermined first ambient air temperature is 0 degrees Fahrenheit;

the predetermined first brake cylinder pressure is 18.5 pounds per square inch.

the predetermined idle period of time is 15 minutes;

the predetermined battery charging current is 20 amperes;

the predetermined second battery voltage is 69 volts;

the predetermined second ambient air temperature is 10 degrees Fahrenheit; and the predetermined second brake cylinder pressure is 22 pounds per square inch.

20. The method of claim 18 further comprising shutting off an air conditioning system of the off-highway vehicle after a predetermined period of time in the idle state.

21. The method of claim 20 wherein the predetermined period of time in the idle state is 1 hour.

22. An off-highway vehicle having an idle state wherein the off-highway vehicle produces no motive force in the idle state and the off-highway vehicle is in said idle state, said vehicle comprising:

an engine;

a controller for controlling operation of the engine, said controller monitoring at least one of a battery voltage of the vehicle, an ambient air temperature of the vehicle, a direction input of the vehicle, a brake cylinder pressure of the vehicle, an engine start input of the vehicle, and a battery charging current;

said controller starting the engine in response to at least one of the following start-up conditions:

the monitored battery voltage is less than a predetermined first battery voltage;

the monitored ambient air temperature is less than a predetermined first ambient air temperature;

the monitored direction input is changed from neutral to either forward or reverse;

the monitored brake cylinder pressure is below a predetermined first brake cylinder pressure; and the monitored engine start input is activated by an operator; and said controller stopping the engine after a predetermined idle period of time in response to at least one of the following shutdown conditions:

the monitored battery charging current is less than a predetermined battery charging current;

the monitored battery voltage is greater than a predetermined second battery voltage;

the monitored ambient air temperature is greater than a predetermined second ambient air temperature;

the monitored direction input is in neutral; and the monitored brake cylinder pressure is above a predetermined second brake cylinder pressure;

wherein at least one of:

(1) the predetermined idle period of time begins when all of the shutdown conditions are met and the predetermined idle period of time is restarted if any of the shutdown conditions are violated;

(2) the predetermined idle period of time begins when the engine of the off-highway vehicle has reached a revolutions per minute corresponding to idle and the predetermined idle period of time is only restarted if the engine is increased to a revolutions per minute above a revolutions per minute corresponding to idle such that if the engine of the off-highway vehicle has not been at a revolutions per minute above a revolutions per minute corresponding to idle for the predetermined idle period of time and all of the shutdown conditions are met at the end of the predetermined idle period of time, the engines are stopped;

(3) the predetermined idle period of time begins when a throttle position of the off-highway vehicle is in a position corresponding to idle and the direction input is in neutral, and the predetermined idle period of time is restarted only if the revolutions per minute of the engine increases above the revolutions per minute corresponding to idle;

(4) the predetermined idle period of time begins when the throttle position is changed to the position corresponding to idle and the predetermined idle period of time is restarted only if the throttle position is changed to a position other than the position corresponding to idle; and (5) the predetermined idle period of time begins when a revolutions per minute setting of the engine is set to an idle setting and the engine is stopped when the predetermined idle period of time ends and all of the shutdown conditions are met, and wherein the predetermined idle period of time is reset only if the throttle position is changed from the position corresponding to idle to another position.

* * * * *